US007028871B1

(12) United States Patent
Glover et al.

(10) Patent No.: US 7,028,871 B1
(45) Date of Patent: Apr. 18, 2006

(54) MUSICAL INSTRUMENT SUPPORT STRAP AND METHOD OF MANUFACTURE

(76) Inventors: Zachery K. Glover, 139 Dowdy Dr., Florence, AL (US) 35634; Rodger G. Carter, 741 Hwy 144, Russellville, AL (US) 35654

( * ) Notice: Subject to any disclaimer, the term of this patent is extended or adjusted under 35 U.S.C. 154(b) by 397 days.

(21) Appl. No.: 10/234,399

(22) Filed: Sep. 4, 2002

(51) Int. Cl.
*A45F 3/14* (2006.01)
*B27J 1/02* (2006.01)

(52) U.S. Cl. ..... 224/258; 224/910; 84/327; 112/475.01; 87/13

(58) Field of Classification Search ..... 224/231, 224/258, 910, 257; 84/327; 2/263, 311; D2/626; D17/20; 112/475.01; 87/13
See application file for complete search history.

(56) References Cited

U.S. PATENT DOCUMENTS

| | | | | | |
|---|---|---|---|---|---|
| 371,159 | A | * | 10/1887 | Wheeler | 229/120.36 |
| 594,201 | A | * | 11/1897 | Frothingham | 2/322 |
| 665,043 | A | * | 1/1901 | Weaver | 2/325 |
| 1,431,846 | A | * | 10/1922 | Slavens | 2/322 |
| 1,679,738 | A | * | 8/1928 | Origone | 383/7 |
| 1,719,145 | A | * | 7/1929 | Stover | 2/338 |
| 1,792,158 | A | * | 2/1931 | Gleckner | 2/322 |
| 1,847,182 | A | * | 3/1932 | Heyer | 2/322 |
| 1,871,785 | A | * | 8/1932 | George | 383/117 |
| 2,630,255 | A | * | 3/1953 | Finder | 224/258 |
| 3,403,430 | A | * | 10/1968 | Steinborn | 24/589.1 |
| 3,688,012 | A | * | 8/1972 | Vettel | 84/327 |
| D231,053 | S | * | 4/1974 | Bryant | D2/626 |
| D249,386 | S | | 9/1978 | Zacuto | D56/1 R |
| 4,148,423 | A | | 4/1979 | Schlacher | 224/258 |
| 4,279,367 | A | | 7/1981 | Jacobs | 224/257 |
| 4,291,822 | A | | 9/1981 | Simonds | 224/257 |
| 4,858,801 | A | | 8/1989 | Sameniego | 224/264 |
| D306,871 | S | | 3/1990 | Bracy | D17/20 |
| 4,930,695 | A | | 6/1990 | Thompson et al. | 224/257 |
| 4,966,062 | A | | 10/1990 | Driggers et al. | 84/327 |
| 5,069,103 | A | | 12/1991 | Healy | 84/327 |
| D335,136 | S | | 4/1993 | McMichael | D17/20 |
| 5,332,137 | A | | 7/1994 | Violette | 224/257 |
| 5,431,320 | A | | 7/1995 | Hash | 224/258 |
| 5,483,860 | A | | 1/1996 | Adams | 84/327 |
| 5,503,315 | A | | 4/1996 | Ruzika et al. | 224/257 |
| 5,596,158 | A | * | 1/1997 | Tonon | 84/327 |
| 5,868,293 | A | * | 2/1999 | D'Addario et al. | 224/257 |
| D408,435 | S | | 4/1999 | Gettings | D17/20 |
| D409,648 | S | | 5/1999 | Gettings | D17/20 |
| 5,936,173 | A | | 8/1999 | Tonon | 84/327 |
| 6,031,166 | A | | 2/2000 | Petrarca | 84/327 |
| 6,040,509 | A | | 3/2000 | Fanella | 84/280 |
| 6,199,731 | B1 | * | 3/2001 | Lehoux | 224/260 |
| D479,554 | S | * | 9/2003 | Boron et al. | D17/20 |
| 2001/0042765 | A1 | * | 11/2001 | Hood et al. | |

* cited by examiner

*Primary Examiner*—Sue A. Weaver
(74) *Attorney, Agent, or Firm*—Thomas, Kayden Horstemeyer & Risley, L.L.P.

(57) ABSTRACT

A device for supporting a musical instrument on a shoulder of an individual is disclosed. The device includes a first end segment adapted to be connectable to a first portion of a musical instrument, a second end segment adapted to be connectable to a second portion of a musical instrument and a plurality of discrete body segments. Each body segment of the plurality of body segments is interlinked with at least one other body segment between the end segments to form a unitary segmented strap. A method of making a device for supporting a musical instrument on the shoulder of an individual is also disclosed.

10 Claims, 3 Drawing Sheets

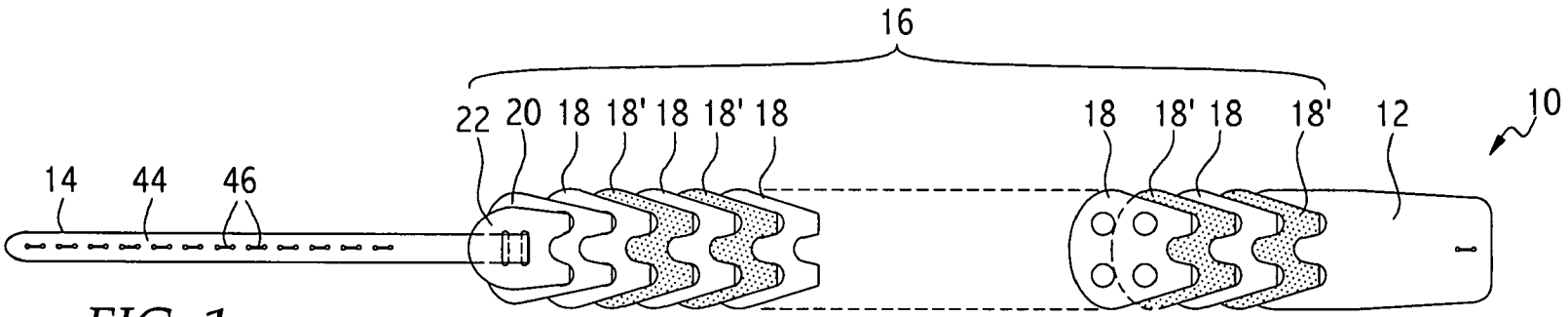
FIG. 1
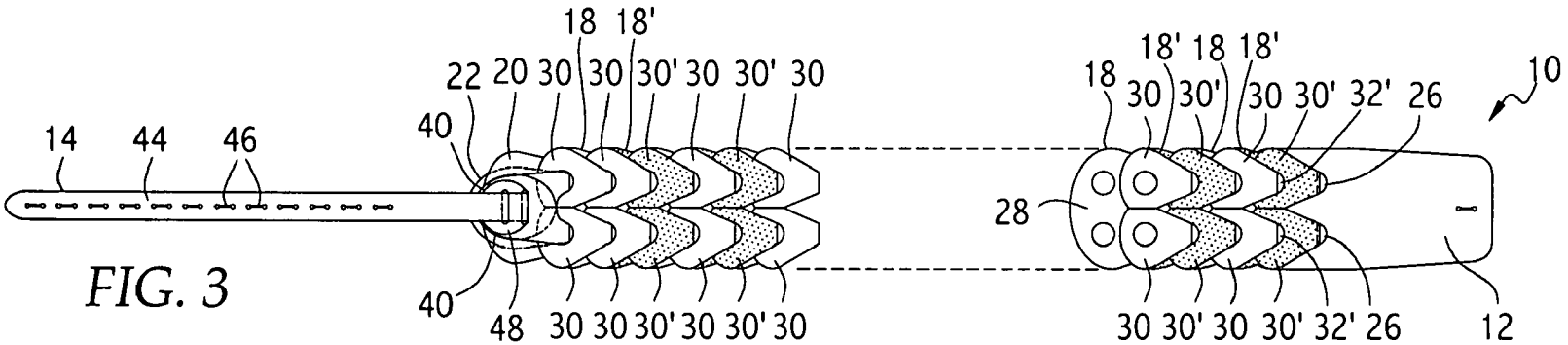
10
12
26
32'
30'
30
18'
18
30'
30
18
28
30
30'
30
18'
18
30
30'
30
30
30

MUSICAL INSTRUMENT SUPPORT STRAP AND METHOD OF MANUFACTURE

BACKGROUND OF THE INVENTION

1. Field of the Invention

The present invention relates generally to the field of musical instrument support devices, and more particularly, to a shoulder strap for supporting a musical instrument in a comfortable playing position.

While the present invention is subject to a wide range of applications, it is particularly well suited for supporting a guitar in a proper playing position in front of a person.

2. Technical Background

Musical instruments come in a variety of shapes and sizes and are played in a number of different ways. Some instruments, such as pianos, are played while seated, while other instruments such as guitars, are generally played while standing. The later generally have to be held in a playing position for significant periods of time and are often heavy or become heavy to the musician during extending playing periods. In the case of musical instruments that are played with the hands and arms, such as guitars, prolonged playing quickly results in fatigue which may adversely affect the quality of play and may result in significant discomfort to the performer.

As a result of these adverse consequences, numerous attempts have been made to support the weight of such musical instruments on the larger body parts of performers, such as, but not limited to, the shoulders, back, and or waist in an effort to extend the comfortable playing time available to the performer, and significantly reduce the arm and hand fatigue associated with playing the musical instrument. By far the most widely used support device for musical instruments played while standing, such as, but not limited to guitars, is the shoulder strap. In the case of guitars, an elongated strap is generally affixed at its ends to spaced anchor points on the guitar and the strap or sling is extended over the players shoulder and across his or her back to support the weight of the guitar.

Although the musical instrument support device of the present invention may be utilized with any number of musical instruments, the device of the present invention will be described hereafter with reference to its use as a support strap for a guitar. One of skill in the art will readily recognize that the present invention may also be used to support other musical instruments and devices. Accordingly, the present invention is in no way limited to the field of guitars.

Generally speaking, a guitar includes a body and an elongated neck extending from the body. The neck carries a finger board over a major portion thereof, and includes a heel portion at a first end where it joins the body and a head portion at the second end remote from the body. The strings extend along the elongated neck and are fastened to a suitable support structure on the body at one end and to a suitable tuning mechanism on the head portion. The first of two anchor points is typically located on the body generally in line with the neck along the side of the body opposite the location where the neck is joined with the body. Depending on the instrument, and to some extent, on user preferences, the second of the two anchor points may be located on the instrument body generally proximate the heel, or at a position proximate the head.

Traditional single strap support mechanism configured to utilize the typical two anchor point configuration on a guitar, although less comfortable than other known support devices, are the most commonly used devices, since they provide the most flexibility for freedom of movement for a user. Because the weight of the guitar is almost entirely supported on a single shoulder of the user, however, fatigue and discomfort are still two significant drawbacks to the use of such devices. Generally speaking, such straps are manufactured from a single piece of material that is generally only flexible when bent from end to end. Although attempts, such as the development of curved straps, have been made to overcome this shortcoming, shoulder straps having flexibility in numerous directions appear to be absent in the art.

What is needed therefore, but presently unavailable in the art, is a musical instrument shoulder strap that is comfortable to the user over extended periods of time, flexible in numerous directions, light in weight, and sturdy in construction. Of particular importance is that the shoulder strap provide flexibility (or give) in the lengthwise direction of the strap. Such a device should be inexpensive to manufacture and adjustable in size. It is to the provision of such a musical instrument support strap that the present invention is primarily directed.

SUMMARY OF THE INVENTION

One aspect of the present invention relates to a device for supporting a musical instrument on the shoulder of an individual. The device includes a first end segment adapted to be connectable to a first portion of a musical instrument, a second end segment adapted to be connectable to a second portion of a musical instrument, and a plurality of discrete body segments. Each body segments of the plurality of body segments is interlinked with at least one other body segment between the end segments to form a unitary segmented strap.

In another aspect the present invention is directed to a method of making a device for supporting a musical instrument on the shoulder of an individual. The method includes the step of interlinking a plurality of discrete body segments together between a first end segment adapted to be connectable to a portion of a musical instrument and a second end segment adapted to be connectable to another portion of the musical instrument. Each body segment of the plurality of body segments is coupled to at least one other body segment to form an elongated segmented strap.

In yet another aspect, the present invention relates to a musical instrument support device. The device includes a plurality of discrete segments interlinked with one another to form an elongated segmented strap, wherein each discrete segment of the plurality of discrete segments is coupled to at least one other discrete segment.

The musical instrument support device of the present invention results in a number of advantages over other musical instrument support devices known in the art. For example, the support device or strap of the present invention requires no stitching, cabling, backing, or other elongate support structure for interconnecting the plurality of discrete segments that form the strap of the present invention. Instead, these segments are interlinked with adjacent segments along the length of the device to form the strap. As a result of this interlinked arrangement, the support strap of the present invention enjoys, among other things, greater flexibility than other support straps known in the art. In addition to being flexible when bent from end to end, the support strap of the present invention enjoys lateral flexibility (i.e., flexibility in a direction substantially normal to the longitudinal axis extending along the length of the strap), and more importantly, longitudinal flexibility or give (i.e., flexibility in the direction of the longitudinal axis or substantially parallel to the longitudinal axis extending along the length of the strap). Such multi-directional flexibility provides additional comfort for the user, and reduces fatigue.

In addition to these advantages, the support strap of the present invention is relatively inexpensive to manufacture and may be readily resized or retrofit to meet the length preference for small, medium, and large individuals, and all sizes in-between. Once suitable dies have been made, numerous segments may be die-cut for either hand or machine assembly. Segments are added in a chain-like manner until the desired strap length is achieved, at which time an end segment may be utilized to removably secure the interlinked segments to one another at the desired length. The constructed strap may then be packaged and sold if desired. If the strap is not sized to the end user's liking, the end user may simple remove the end segment, preferably without tools, add or remove linked segments until the users desired length is achieved, and then re-attach the end segment to again secure the interlinked segments together.

In addition to the above-mentioned advantages of the present invention, a user may also customize the support strap of the present invention to that users particular liking. More specifically, segments having different features and characteristics may be interlinked according to a particular color scheme, or to achieve some other design feature. For example, in addition to those embodiments specifically shown and described hereafter, the discrete body segments of the present invention may be triangularly shaped, heart shaped, or otherwise adapted to take on some design characteristic. Moreover, the same or different colors may be utilized for each of the segments or groups of segments.

Additional features and advantages of the invention will be set forth in the detailed description which follows, and in part will be readily apparent to those skilled in the art from that description or recognized by practicing the invention as described herein.

It is to be understood that both the foregoing general description and the following detailed description are merely exemplary of the invention, and are intended to provide an overview or framework for understanding the nature and character of the invention as it is claimed. The accompanying drawings are included to provide further understanding of the invention, illustrate various embodiments of the invention, and together with the description serve to explain the principles and operation of the invention.

BRIEF DESCRIPTION OF THE DRAWINGS

FIG. 1 is a top view of a preferred musical instrument support strap in accordance with the present invention.

FIG. 3 is a bottom view of the support strap depicted in FIG. 1 showing the cooperation of the various segments.

FIG. 4 is a side elevational view of the support strap depicted in FIG. 1.

DETAILED DESCRIPTION OF THE PREFERRED EMBODIMENT

Figure 2:
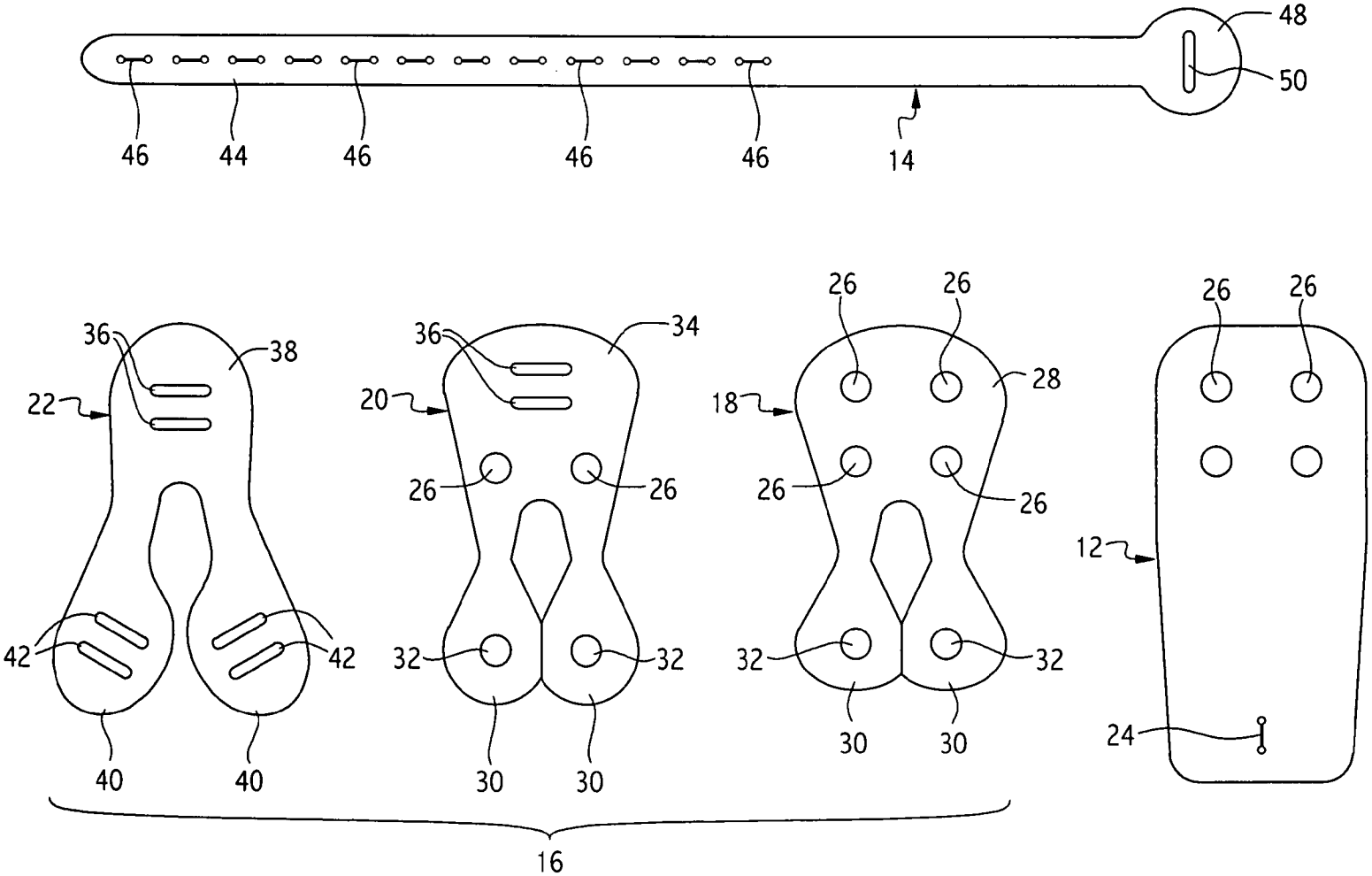
FIG. 2 is a top view depicting the various preferred segments used to make the support strap depicted in FIG. 1.

Reference will now be made in detail to the present preferred embodiments of the invention, an example of which is illustrated in the accompanying drawing figures. Wherever possible, the same reference numerals will be used throughout the drawing figures to refer to the same or like parts. An exemplary embodiment of the musical instrument support strap is shown in FIG. 1 and is designated generally throughout by reference numeral 10.

Generally speaking, preferred musical instrument support strap 10 depicted in FIG. 1 includes a first end segment 12 adapted to be connectable to a rear mounting peg at or near the base portion of a guitar or some other musical instrument, a second end segment 14 adapted to be connectable to a forward mounting bracket of a guitar or some other musical instrument, and a plurality of discrete body segments 16 interlinked to one another and preferably to the end segments to form an elongated segmented strap.

Although optional, body segments 16 may preferably include a plurality of central body segments 18 and a plurality of central body segments 18' that are more flexible than central body segments 18. Preferably, flexible central body segment 18' is more thin than central body segment 18. In a preferred embodiment of the present invention, each central body segment 18' may be interlinked with and between a pair of central body segments 18 or a central body segment 18 and another type of segment. In this way, both flexibility and strength may be distributed substantially uniformly along the length of strap 10. In addition, body segments 16 may further preferably include a transition body segment 20 and a tapering body segment 22 positioned between second end segment 14 and the terminal central body segment 18 or 18'. As will be explained in greater detail below, transition body segment 20 and tapering body segment 22 may preferably be utilized to facilitate the interlinking of second end segment 14 to support strap 10.

Although any flexible or semi-flexible material may be utilized to manufacture musical instrument support strap 10 in accordance with the present invention, support strap 10, and all of its various segments 12, 14, 16, 18, 18', 20, and 22 are preferably constructed of leather. It will be understood, however, that the various segments could be made of vinyl, naugahide, a natural fiber material, a synthetic fiber material or some other non-rigid material. In accordance with the preferred embodiment of the present invention, first end segment 12, second end segment 14, central body segments 18, transition body segment 20 and tapering body segment 22 are preferably constructed from cowhide grade leather having a weight in the range from about 5.0 ounces to about 1¾ ounces and a thickness from about 7.0 millimeters to about 2.0 millimeters. More preferably, the weight is about 3½ ounces and the thickness is approximately 3.5 millimeters. Flexible central body segments 18', on the other hand, are preferably constructed of garment grade leather having a weight in the range from about 3½ ounces to about 0.75 ounces and a thickness from about 1.5 millimeters to about 0.3 millimeters. Most preferably, flexible central body segments 18' have a weight of approximately 1½ ounces and a thickness of about 0.6 millimeters. Generally speaking, the differences in grade, weight, and thickness of the materials provide enhanced flexibility and moveability to support strap 10. In addition, when support strap 10 is constructed as shown in FIG. 1 (body segments 16 being interlinked such that a flexible central body segment 18' is connected between a pair of central body segments 18 along the length of musical instrument support strap 10), enhanced flexibility is achieved without any significant sacrifice in strength.

The individual segments of musical instrument support strap 10 are shown unlinked and in greater detail in FIG. 2. First end segment 12 preferably includes a peg orifice 24 that facilitates the connection of first end segment 12 to a strap peg (not shown) on the base of a guitar or other musical instrument, and a plurality of base orifices 26, preferably arranged in rows and columns.

Central body segment 18 is preferably sized and shaped to include a base portion 28 defining a plurality of base orifices 26, and a plurality of linking tabs 30, each defining a tab orifice 32. Although not depicted in FIG. 2, flexible central body segment 18' incorporates features similar to or identical to those depicted for central body segment 18. In a preferred embodiment, the differences between central body segments 18 and flexible central body segments 18' relate, among other things, to the differences in the grade, weight, and/or thickness of the material used to construct the segments as described previously above.

Transition body segment 20 preferably includes a base portion 34 defining a plurality of base orifices 26 and a plurality of securing slots 36. In addition, transition body segment 20 also preferably includes a pair of linking tabs 30 each defining a tab orifice 32.

Tapering body segment 22 preferably includes a tapered base portion 38 defining a plurality of securing slots 36 and a pair of linking tabs 40, each defining a plurality of securing slots 42.

Second end segment 14 preferably defines an elongated belt having an adjustable positioning portion 44 defining a plurality of spaced connection slots 46 which may preferably be connected to a second strap peg (not shown) or other support member on the guitar or other musical instrument, and an interlocking tab 48 defining an interlocking slot 50.

A preferred method of manufacturing musical instrument support strap 10 in accordance with the present invention will now be described with reference to FIGS. 3 and 4. As one of skill in the art will readily understand, a suitable die or other device may preferably be utilized to form each of the segments depicted in FIG. 2. The segments may then preferably be interlinked in accordance with the following steps. First end segment 12, preferably constructed of cowhide, is preferably held or otherwise supported while the linking tabs 30' of a flexible central body segment 18' are urged through the forward base orifices 26 in first end segment 12. Linking tabs 30' are then preferably folded back such that tab orifices 32' are substantially aligned with the rear base orifices 26 of first end segment 12. As used herein, the term, "forward" when used in connection with the location of orifices or slots, means those orifices or slots that are nearest peg orifice 24 defined by first end segment 12 when strap 10 is in an assembled configuration. Likewise, the term, "rear" when used in connection with the location of orifices or slots, means those orifices or slots that are farthest from peg orifice 24 defined by first end segment 12 when strap 10 is in an assembled configuration.

Linking tabs 30 of a central body segment 18 may then preferably be urged through forward base orifices 26' in flexible central body segment 18', through rear base orifices 26 in first end segment 12, and then through tab orifices 32' in linking tabs 30' of flexible central body segment 18'. Linking tabs 30 may then preferably be folded back such that tab orifices 32 are aligned with rear base orifices 26' of flexible central body segment 18' and forward base orifices 26 in central body segment 18, thus forming the next succeeding link in the chain of links that will form the interlinked segmented strap of the present invention upon completion of the method steps.

The above-mentioned steps are repeated in sequence until the linked segments approach the desired strap length. Thereafter, the chain of linked segments may preferably be tapered and secured as will now be described with reference again to FIGS. 3 and 4.

Once the chain of segments is sufficiently near the desired length, the last central body segment, in this case, a central body segment 18 is held or otherwise supported while linking tabs 30 of a transition body segment 20 are urged through base orifices 26 and 26' of a central body segment 18 and a preceding flexible central body segment 18', respectively, and then through linking tabs orifices 32' of the preceding flexible central body segment. Linking tabs 30 are then preferably folded back such that tab orifices 32 are aligned with rear base orifices 26 in central body segment 18 and base orifices 26 in transition body segment 20. Linking tabs 40 of tapering segment 22 may then preferably be urged through aligned base orifices 26 and tab orifices 32 of the preceding segments. Linking tabs 40 may then preferably be folded back and overlapped such that securing slots 42 are in alignment with securing slots 36 in the base portion 34 of transition body segment 20 and the securing slots 36 in tapered base portion 38 of tapering body segment 22. Adjustable position portion 44 of second end segment 14 may then be passed through the forward securing slots 42 and 36, folded back and passed back down through the rear securing slots 36 and 42, and then through the interlocking slot 50 of interlocking tab 48 of the second end segment. Adjustable position portion 44 of second end segment 14 may then be pulled longitudinally of the linked segments such that linking tabs 40, transition body segment 20 and tapering body segment 22 are cinched between adjustable positioning portion 44 and interlocking tab 48 of second end segment 14 thereby completing the segmented support strap 10 and securing each of the segments together. The resulting musical instrument support strap 10 may then be affixed to the guitar or other musical instrument to support the weight of the guitar or other musical instrument on the shoulder of a user.

As shown in FIG. 4, the construction of musical instrument support strap 10, and particularly the alternating interlinking of flexible central body segments 18' with standard central body segments 18 may enable the support strap 10 to be flexible in a direction longitudinal of the strap as indicated by arrows 52. Although not described above, one of skill in the art will recognize that musical instrument support strap 10 may be disassembled by reversing the method steps described above. Once second end segment 14 has been removed, a user may simple sequentially remove the desired number of body segments 16 and reattach the transition body segment 20, tapering body segment 22 and second end segment 14, as described above.

Although the invention has been described as incorporating two sets of base orifices 26, one of skill in the art will recognize that fewer base orifices, such as one set of two orifices may also be employed in accordance with the present invention. Fewer base orifices 26 will result in less overlapping, and thus, a musical instrument support strap that may have less overall strength. Accordingly, it is preferred that a plurality of sets of base orifices 26 be employed in accordance with a preferred embodiment of the present invention.

Figure 5:
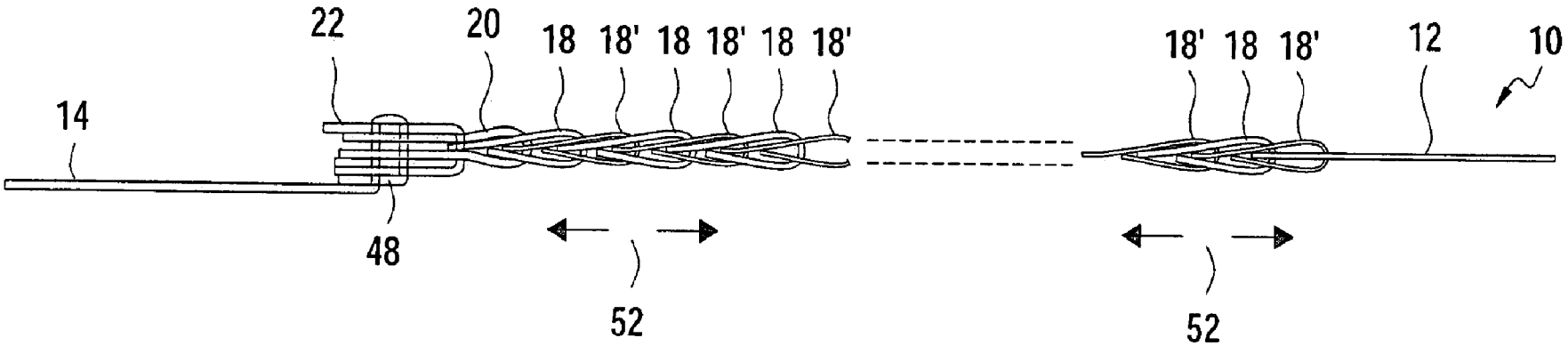
FIG. 5 is a side elevational view of the support strap depicted in FIG. 1 in accordance with one exemplary embodiment of the present invention.

FIG. 5 depicts an embodiment of the musical instrument strap 10 for which the central body segments 18' are shown to be more thin than the central body segments 18.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. For example, the various segments may be shaped differently than those shown in the drawing figures above. In addition, orifice arrangements other than the orifice arrangements shown and described above may be utilized to facilitate the interlinking of the plurality of body segments of the present invention. Therefore, the above-mentioned description is considered to be exemplary, rather than limiting and the true scope of the invention is that defined in the following claims.

What is claimed is:

1. A device for supporting a musical instrument on a shoulder of an individual, the device comprising:

a first end segment adapted to be connectable to a first portion of a musical instrument;

a second end segment adapted to be connectable to a second portion of the musical instrument; and a plurality of discrete body segments, each body segment of the plurality of body segments interlinked with at least one other body segment between the end segments to form a unitary segmented strap, wherein at least one of the body segments is interlinked with more than one body segment, wherein each of the plurality of body segments is constructed and arranged to extend through and overlap a portion of at least one adjacent body segment, and wherein a plurality of the body segments overlap at least a portion of more than one adjacent body segment.

2. The device of claim 1 wherein the first end segment and the second end segment are each interlinked with a body segment.

3. The device of claim 2 wherein each of the end segments and each of the body segments are interlinked with more than one body segment.

4. The device of claim 1 wherein at least one of the plurality of discrete body segments is interlinked with at least three other body segments.

5. The device of claim 1 wherein at least one of the plurality of discrete body segments has at least five orifices.

6. The device of claim 5 wherein portions of other body segments respectively pass through each of the orifices.

7. A device for supporting a musical instrument on a shoulder of an individual, the device comprising:

a first end segment adapted to be connectable to a first portion of a musical instrument;

a second end segment adapted to be connectable to a second portion of the musical instrument; and a plurality of discrete body segments, each body segment of the plurality of body segments interlinked with at least one other body segment between the end segments to form a unitary segmented strap, wherein the plurality of discrete body segments comprise a plurality of thick body segments and a plurality of thin body segments and wherein the thick body segments are alternatingly interlinked with the thin body segments.

8. A device for supporting a musical instrument on a shoulder of an individual, the device comprising:

a first end segment adapted to be connectable to a first portion of a musical instrument;

a second end segment adapted to be connectable to a second portion of the musical instrument; and a plurality of discrete body segments, each body segment of the plurality of body segments interlinked with at least one other body segment between the end segments to form a unitary segmented strap, wherein at least one of the body segments is interlinked with more than one body segment, wherein the plurality of discrete body segments comprise a plurality of thick body segments and a plurality of thin body segments, and wherein at least one of the thick body segments is interlinked with at least one of the thin body segments.

9. A method of making a device for supporting a musical instrument on the shoulder of an individual, the method comprising the step of:

interlinking a plurality of discrete body segments together between a first end segment adapted to be connectable to a portion of the musical instrument and a second end segment adapted to be connectable to another portion of the musical instrument such that each body segment of the plurality of body segments is coupled to at least one other body segment to form an elongated segmented strap;

attaching a first body segment of the plurality of body segments to the first end segment, wherein the interlinking step comprises the step of successively interlinking the remainder of the plurality of body segments from the first body segment to the second end segment; and removably attaching the second end segment to one or more body segments remote from the first end segment to selectively maintain the interlinked configuration of the elongated segmented strap, wherein the step of removably attaching comprises the steps of:

overlapping a plurality of the body segments adjacent a location remote for the first end segment, the plurality of body segments defining a plurality of orifices;

aligning the plurality of orifices in the plurality of overlapped body segments such that the plurality of orifices form a first and a second passageway through the overlapped plurality of body segments; and weaving the second end segment through the first passageway, the second passageway and back through an aperture defined in the second end segment.

10. A method of making a device for supporting a musical instrument on the shoulder of an individual, the method comprising the step of:

interlinking a plurality of discrete body segments together between a first end segment adapted to be connectable to a portion of the musical instrument and a second end segment adapted to be connectable to another portion of the musical instrument such that each body segment of the plurality of body segments is coupled to at least one other body segment to form an elongated segmented strap, wherein the plurality of body segments comprise a first group of body segments and a second group of body segments thinner that the first group of body segments, and wherein the interlinking step comprises the step of coupling the plurality of body segments such that the plurality of interlinked body segments alternate between a body segment from the first group of body segments and a body segment from the second group of body segments.

* * * * *